US010363673B2

(12) United States Patent
Tsujii

(10) Patent No.: US 10,363,673 B2
(45) Date of Patent: Jul. 30, 2019

(54) THINNING SHEARS

(71) Applicant: Capelito Corporation, Kawanishi, Hyogo (JP)

(72) Inventor: Noriyuki Tsujii, Kawanishi (JP)

(73) Assignee: Capelito Corporation, Kawanishi (JP)

( * ) Notice: Subject to any disclaimer, the term of this patent is extended or adjusted under 35 U.S.C. 154(b) by 0 days.

(21) Appl. No.: 15/565,429

(22) PCT Filed: Jan. 31, 2017

(86) PCT No.: PCT/JP2017/003267
§ 371 (c)(1),
(2) Date: Oct. 10, 2017

(87) PCT Pub. No.: WO2017/138397
PCT Pub. Date: Aug. 17, 2017

(65) Prior Publication Data

US 2018/0126569 A1 May 10, 2018

(30) Foreign Application Priority Data

Feb. 12, 2016 (JP) ..... 2016-024669

(51) Int. Cl.
*B26B 13/08* (2006.01)

(52) U.S. Cl.
CPC ..... *B26B 13/08* (2013.01)

(58) Field of Classification Search
CPC ..... B26B 13/08
USPC ..... 30/195
See application file for complete search history.

(56) References Cited

U.S. PATENT DOCUMENTS 973,296 A * 10/1910 Peddle
2,267,949 A * 12/1941 Reed ..... B26B 13/08 30/195
2,558,264 A * 6/1951 Metcalf ..... B26B 13/24 30/195
4,170,064 A * 10/1979 Senk ..... B26B 13/24 30/195
6,141,877 A * 11/2000 Suetsugu ..... B26B 13/24 30/195
7,159,321 B2 * 1/2007 Yeh ..... B26B 13/08 30/195
9,027,252 B2 * 5/2015 Moseman ..... B26B 19/3846 30/208

(Continued)

FOREIGN PATENT DOCUMENTS

EP 0 163 381 A1 * 3/1985
EP 1 153 712 A1 * 11/2001

(Continued)

*Primary Examiner* — Hwei-Siu C Payer
(74) *Attorney, Agent, or Firm* — James Judge

(57) ABSTRACT

Afforded are thinning shears optimal for cutting crosswise hair growing along the scalp, as well as crosswise hair disturbing the passing of a comb through hair bundles. The thinning shears, in thinning shears furnished with a comb blade and a bar blade for haircutting, are characterized in that the comb blade is longer than the bar blade, and the tip-edge of the comb blade is corner-rounding processed. Adopting this configuration makes it possible to set the tip-edge portion of the comb blade on a scalp and slide the comb blade heading in the direction that the hair grows, to efficiently thin out crosswise hair such as would disturb combing, without injuring the scalp.

6 Claims, 12 Drawing Sheets

(56) References Cited

U.S. PATENT DOCUMENTS

| | | | | |
|---|---|---|---|---|
| 2016/0236362 | A1* | 8/2016 | Stapelbroek | B26B 19/3846 |
| 2016/0271814 | A1* | 9/2016 | Bennik | B26B 19/06 |
| 2017/0312927 | A1* | 11/2017 | Erndt | B26B 19/042 |
| 2018/0126569 | A1* | 5/2018 | Tsujii | B26B 13/08 |

FOREIGN PATENT DOCUMENTS

| | | | |
|---|---|---|---|
| GB | 653 422 | A | 5/1951 |
| JP | H05-76660 | A | 3/1993 |
| JP | 2003-062364 | A | 3/2003 |
| JP | 2005-323951 | A | 11/2005 |

* cited by examiner

- Prior Art -

- Prior Art -

- Prior Art -

THINNING SHEARS

TECHNICAL FIELD

The present invention relates to thinning shears (scissors) used in barber shops and beauty salons.

BACKGROUND ART

As shown in FIG. 11, thinning shears 50 have a comb blade 51 and a bar blade 52, and are a bladed hand tool for shearing what is caught between the two blades. The comb blade 51 has a number of slits at regular intervals. The thinning shears 50 shear hair that is caught between the tips of portions 53, which are called the teeth, formed by the slits, and the bar blade 52. At the same time, the thinning shears 50 do not shear hair inserted into the slits. As a result, the shears 50 can thin out the hair. As indicated with the base line 54, the bar blade 52 of the conventional thinning shears 50 is longer than the comb blade 51, or the bar blade 52 has the same length as that of the comb blade (which is not shown). Also, a tip 55 of the comb blade 51 and a tip 56 of the bar blade 52 each have a sharp corner of 90 degrees.

As shown in FIG. 12, when the thinning shears 50 are used for cutting hair 60, the thinning shears 50 are inserted across a bundle of the hair 60. In this situation, the thinning shears 50 are usually used under a condition in which the bar blade 52 is situated downward. The fact that almost all shears have the bar blade 52 longer than the comb blade 51 seems to be based on this reason. In this conventional haircutting method, the thinning shears 50 are not used under conditions where the tip of the thinning shears 50 contacts the skin of the scalp. Therefore, both the sharpness and length of the bar blade 52 are not factors to be taken into consideration.

PRECEDENT TECHNICAL LITERATURE

Patent Document

Patent Document 1: Japanese Unexamined Pat. App. Pub. No. H08-98963

SUMMARY OF INVENTION

Issues Invention is to Address

Targeting crosswise hair mixed in with straight hair by haircutting methods carried out using conventional thinning shears 50, as shown in FIG. 12, is difficult. Scissors for clipping out gray hairs have also been proposed, yet these scissors take on a form proposed for carefully clipping out gray hairs strand-by-strand, found by visual inspection, so they are not for cutting crosswise hair efficiently (reference is made to Japanese Unexamined Pat. App. Pub. No. 2010-259476). An object of the present invention, brought about for solving the above-described problems, is to make available shears that can efficiently thin out crosswise hair mixed into a bundle of straight hair, and also crosswise hair growing from the scalp in directions different from the rest of the hair.

Means for Addressing the Issues

To solve the abovementioned problems, this invention provides thinning shears for cutting hair, comprising: a comb blade and a bar blade, the comb blade being provided with a number of slits spaced apart at intervals, and having teeth between the slits, the comb blade being longer than the bar blade, the comb blade's tip-edge being corner-rounding processed, and in the tip-edge the teeth being of width not greater than 1 mm; and indentations being provided in the tip-ends of the cutting-teeth; characterized in that by setting the tip-edge of the comb blade on a scalp and using the thinning shears while moving the shears heading in the direction that the hair grows, crosswise hair that grows along the scalp in a direction different from the rest can be caught in the indentations and cut.

It is preferable that the comb-blade teeth in their direction orthogonal to the comb blade longitudinally are rectangular in tip-end cross-section, wherein the comb-blade teeth shear hair caught between the comb blade and the bar blade.

It is preferable that the tip of the bar blade is corner-rounding processed.

It is preferable that in cross section the tip portion of the bar blade opposing the tip teeth portions of the comb blade is rectangular.

Effects of Invention

According to the present invention, a completely new cutting method which can thin out crosswise hair efficiently can be safely performed by a technique of setting the tip of the comb blade on the scalp and moving the comb blade along the direction in which the hair flows.

BRIEF DESCRIPTION OF DRAWINGS

FIG. 2 is an enlarged view of the tip portion of the shears, wherein

FIG. 9 shows a preferable embodiment, wherein.

MODE(S) FOR IMPLEMENTING INVENTION

With respect to haircutting shears of the present invention, the comb blade is longer than the bar blade, and the tip of the comb blade is processed to round off the corners of the tip, and also it is preferable that the tip of the bar blade is processed to round off the corners of the tip. More preferably, the width of the teeth existing at the tip of the comb blade is set 1 mm or less so that the teeth can catch crosswise hair growing in different directions along the scalp from the rest. Said shears can be used for a haircutting method comprising setting the tip of the comb blade on the scalp and moving the comb blade along the direction of the hair flow, without injuring the scalp.

Figure 1:
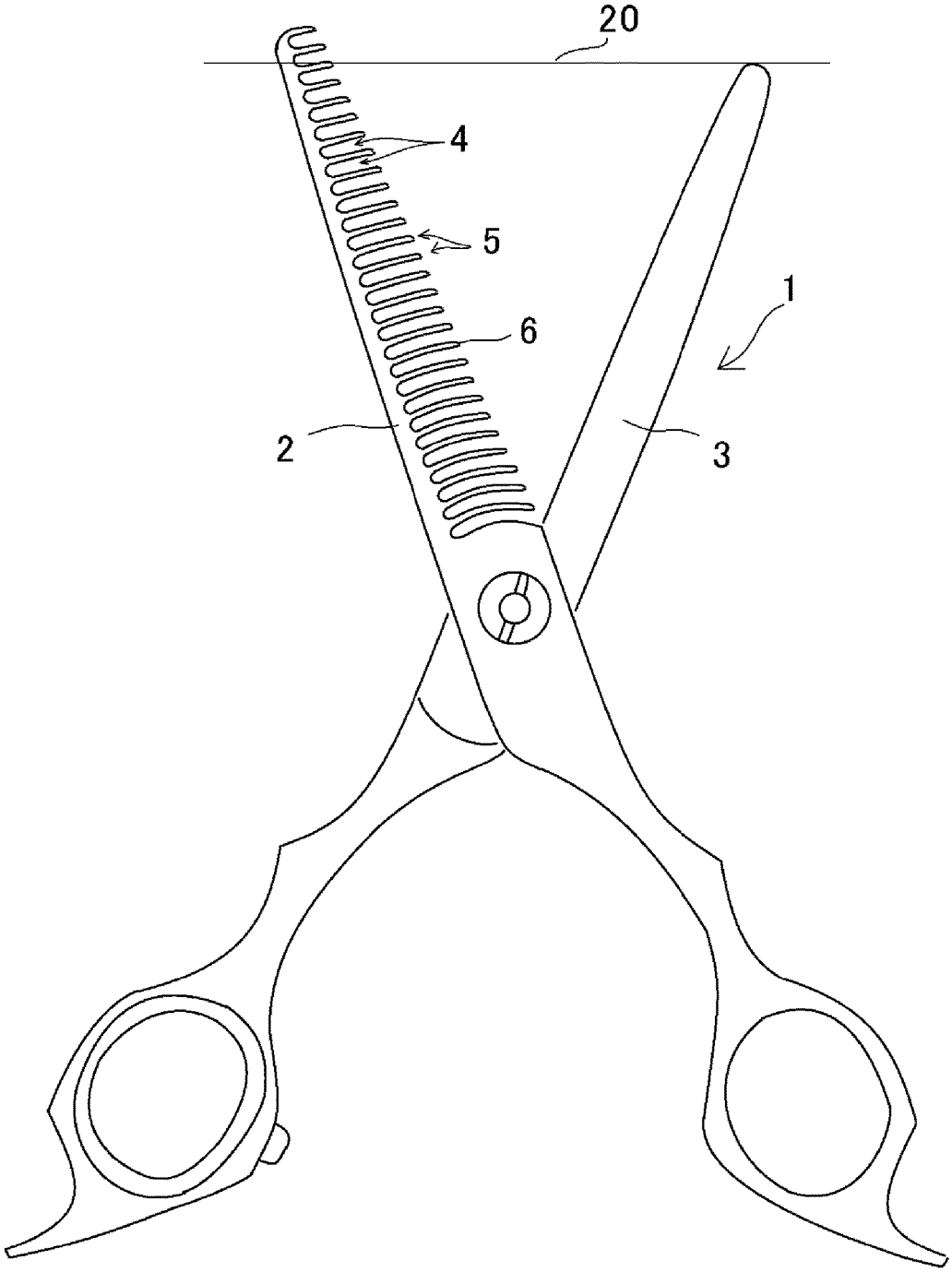
FIG. 1 is a front view of the shears of an embodiment of the present invention.

As shown in FIG. 1, the shears 1 have a comb blade 2 and a bar blade 3. The shears 1 are a bladed hand tool that cuts what is put between the two blades. The comb blade 2 has a number of slits 4 spaced apart at intervals. The teeth 5 formed between the slits 4 can be used as comb. The bar blade 3 is a cutting blade extending along approximately a straight line, and the cross section of the edge-of-blade portion has an acute angle. The shears 1 cut hair put between the teeth 5 and the bar blade 3, but do not cut hair put between the slits 4 and the bar blade 3; therefore, the shears 1 can thin out hair.

As can be understood by viewing the reference line 20, the comb blade 2 is longer than the bar blade 3, with the difference appearing exaggerated in FIG. 1 and in practice being more closely represented by FIGS. 2A, 2B, 3A and 9A, and the tip of the comb blade 2 has been processed to round off the corners of the tip. In this description, the process whereby the sharp edges of the portion of the tip portion that is set on the scalp have been rounded off is hereinafter referred to as "corner-rounding processing." For more detail, as shown in FIG. 1, the corner-rounding processing comprises roundly chamfering the tip of the comb blade 2 into an arcuate form, and further chamfering (at a small radius of curvature) the sharp edges, which exists are perpendicular to the plane of FIG. 1, of the chamfered tip portion to round the edges smooth so as to prevent the scalp from being injured. Similarly, corner-rounding processing has been carried out on the tip portion of the bar blade 3.

The comb blade 2 is longer than the bar blade 3 and the tip is corner-rounding processed. Therefore, the shears can cut crosswise hair which disturbs combing through hair, without injuring the scalp and the other hair, if a shearing method comprising setting the tip of the comb blade on the scalp and moving the comb blade along the direction in which the hair flows is performed (reference is made to FIG. 5 and FIG. 6A). Because the tip of the bar blade 3 is finished by the corner-rounding processing, the shears can prevent the scalp from being injured if the comb blade 2 is leaned too much, or if it is pressed against the scalp forcefully and the shears pinch the scalp between the comb blade 2 and the bar blade 3.

Figure 11:
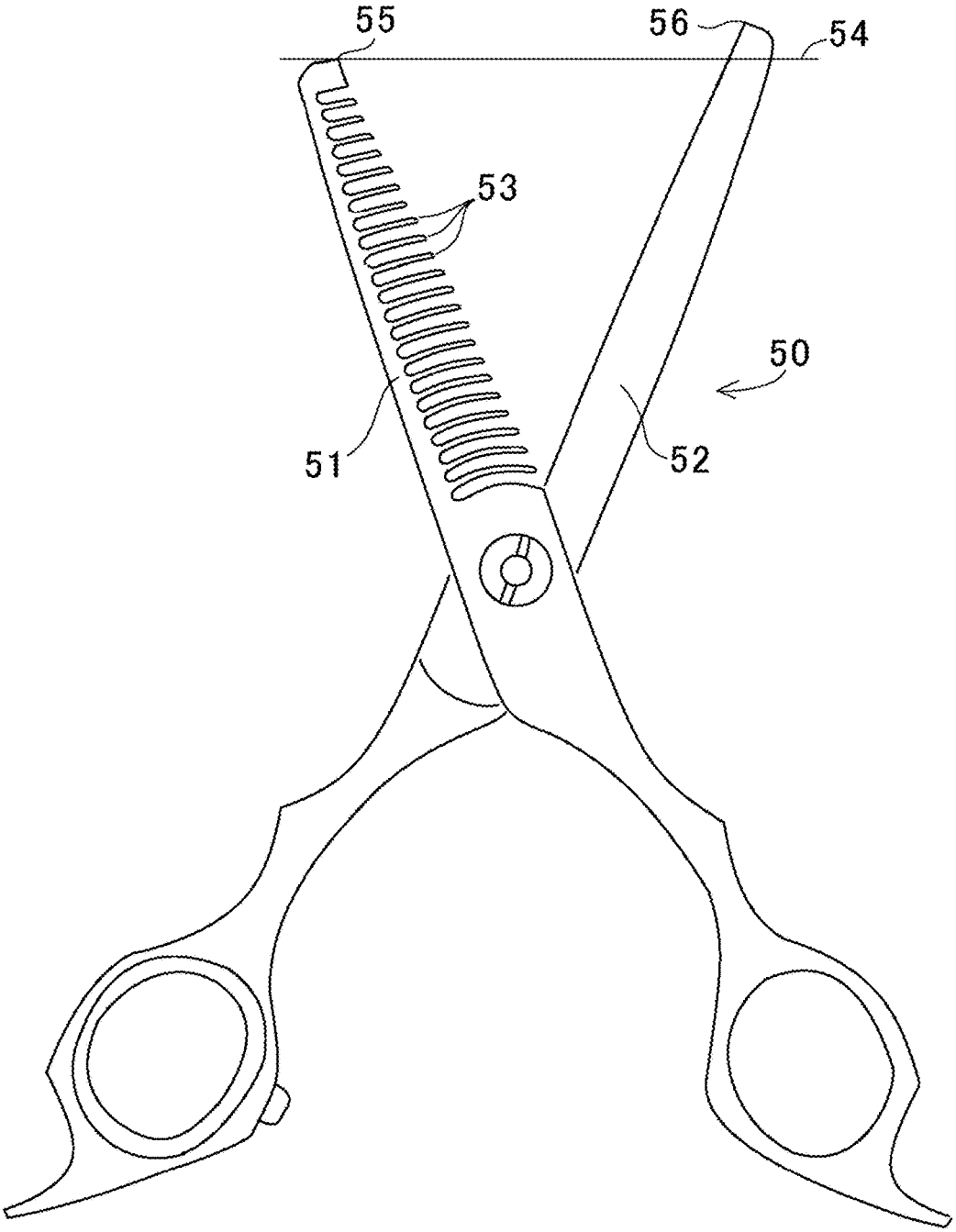
FIG. 11 is a front view of conventional shears.

As shown in FIG. 11, the conventional thinning shears 50 have the bar blade 52 that is longer than the comb blade 51, and also the tips 55, 56 of the comb blade 51 and the bar blade 52 are sharp. In order to perform the above-mentioned shearing method using conventional thinning shears 50, advanced skill for preventing the scalp from being injured is required of the user. However, if the shears 1 are used, the technically significant effect that every person can safely perform this cutting method is recognized.

Figure 2A:
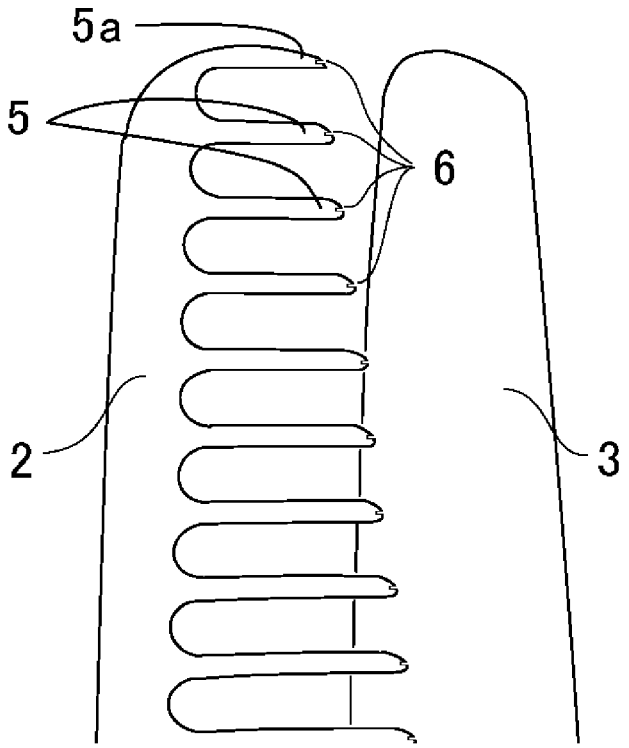
FIG. 2A shows the shears just before closing.
Figure 2B:
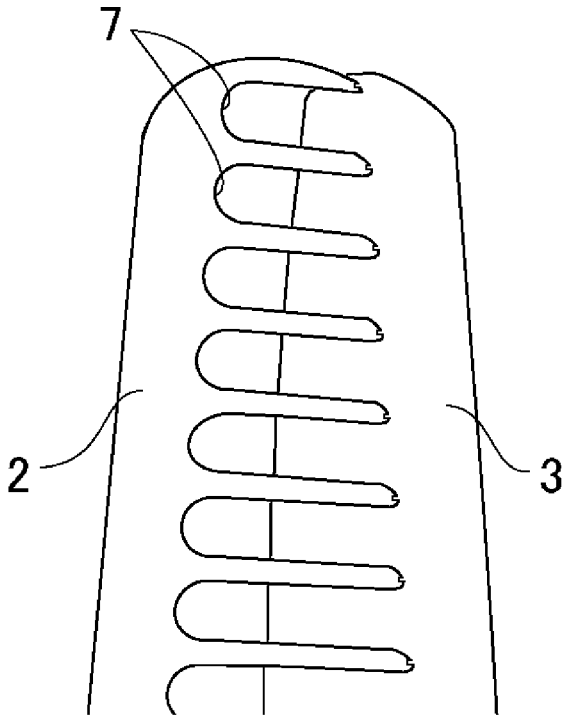
FIG. 2B shows the shears after closing completely.

As shown in FIG. 2A, the tips of the teeth 5 of the comb blade 2 are of convex semicircular form. The end portions of the convex-formed tips have an indentation 6 of size to enable capturing one or two hairs, preferably a single hair; more specifically, the size is 0.1 mm-0.3 mm. As shown in FIG. 2B, even if the shears are closed completely, the bar blade 3 does not reach the deepest portion 7 of the slits of the comb blade 2.

Figure 3A:
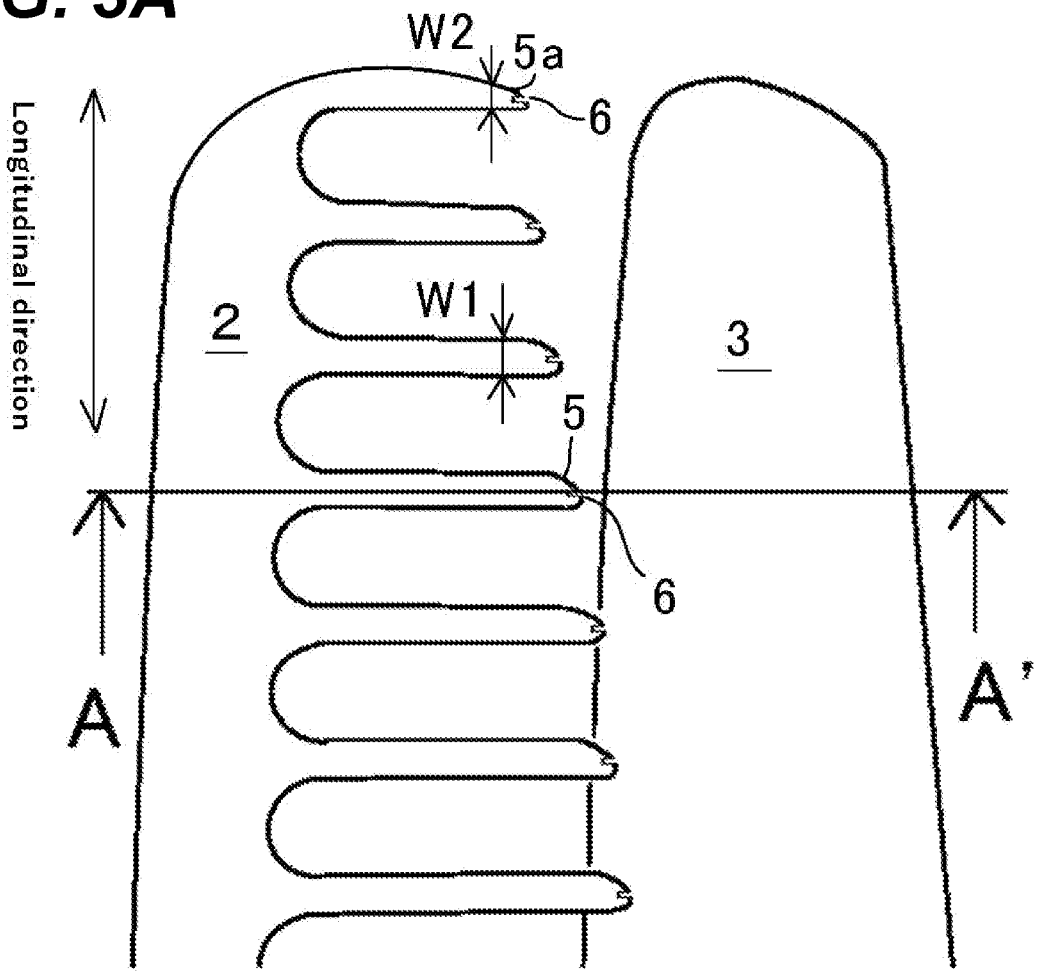
FIG. 3A is the shears just before closing.
Figure 3B:
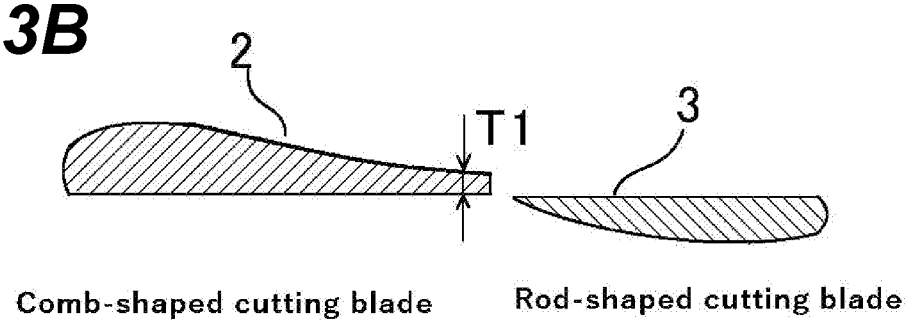
FIG. 3B shows the A-A' line cross section of FIG. 3A.

As shown in FIGS. 3A and B, with respect to the teeth 5 of the comb blade 2, the tip section (A-A' section) in the direction perpendicularly intersecting the comb blade 2 in its longitudinal direction is a rectangle, and the teeth 5, more specifically the indentations 6, shear hair pinched between the teeth 5 or the indentations 6 and the bar blade 3. The tip section is a rectangle, or non-sharp; therefore, the comb blade does not injure the hair by use, even if the comb blade is used as a comb so as to raise and catch crosswise hair which is growing along the scalp. It is desirable that the tooth width $W_1$ is 1 mm or less so that the teeth can well capture crosswise hair which is growing in a different direction from the rest. Also, it is desirable that the thickness $T_1$ is 0.5 mm or less. Although the shears 1 are used on the condition that the comb blade 2 is set on the scalp, teeth from the top-end tooth 5*a* to the third or fourth tooth 5 can effectively thin out crosswise hair. For this purpose, an indentation 6 is formed in the top-end tooth 5*a* of the comb blade 2, as shown in FIG. 3A, differing from the conventional thinning shears 50 as shown in FIG. 11. Thereby, crosswise hair can be cut near the hair roots. It is desirable that the tooth width $W_2$ is 1 mm or less likewise as the width $W_1$ of the other tooth 5, under the condition that the corner-rounding processing has been carried out on the tip portion of the comb blade 2.

Figure 4:
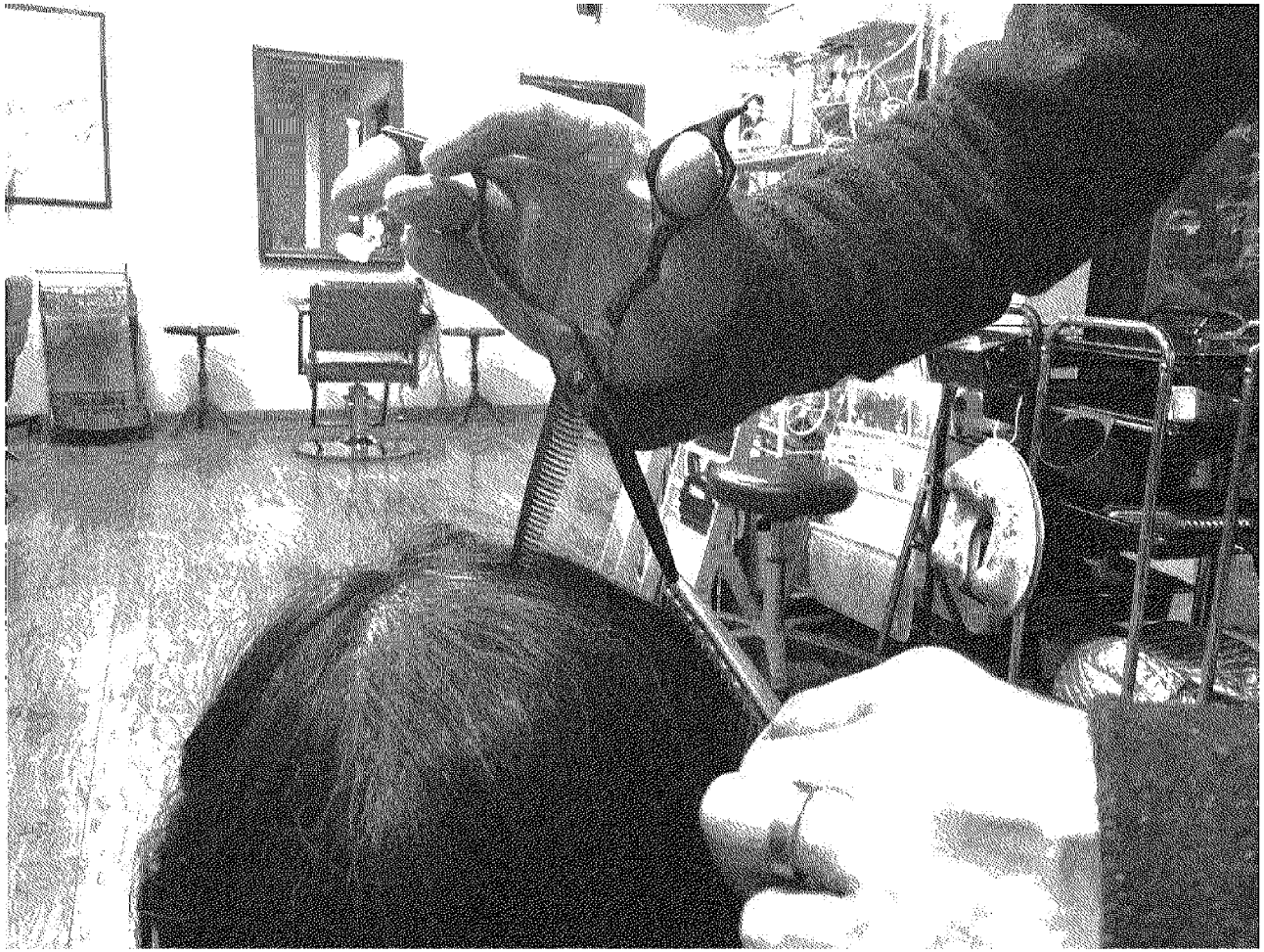
FIG. 4 is a photograph illustrating the hair cutting method comprising setting the tip of the comb blade on the scalp and moving the comb blade along the direction of hair flow.
Figure 5:
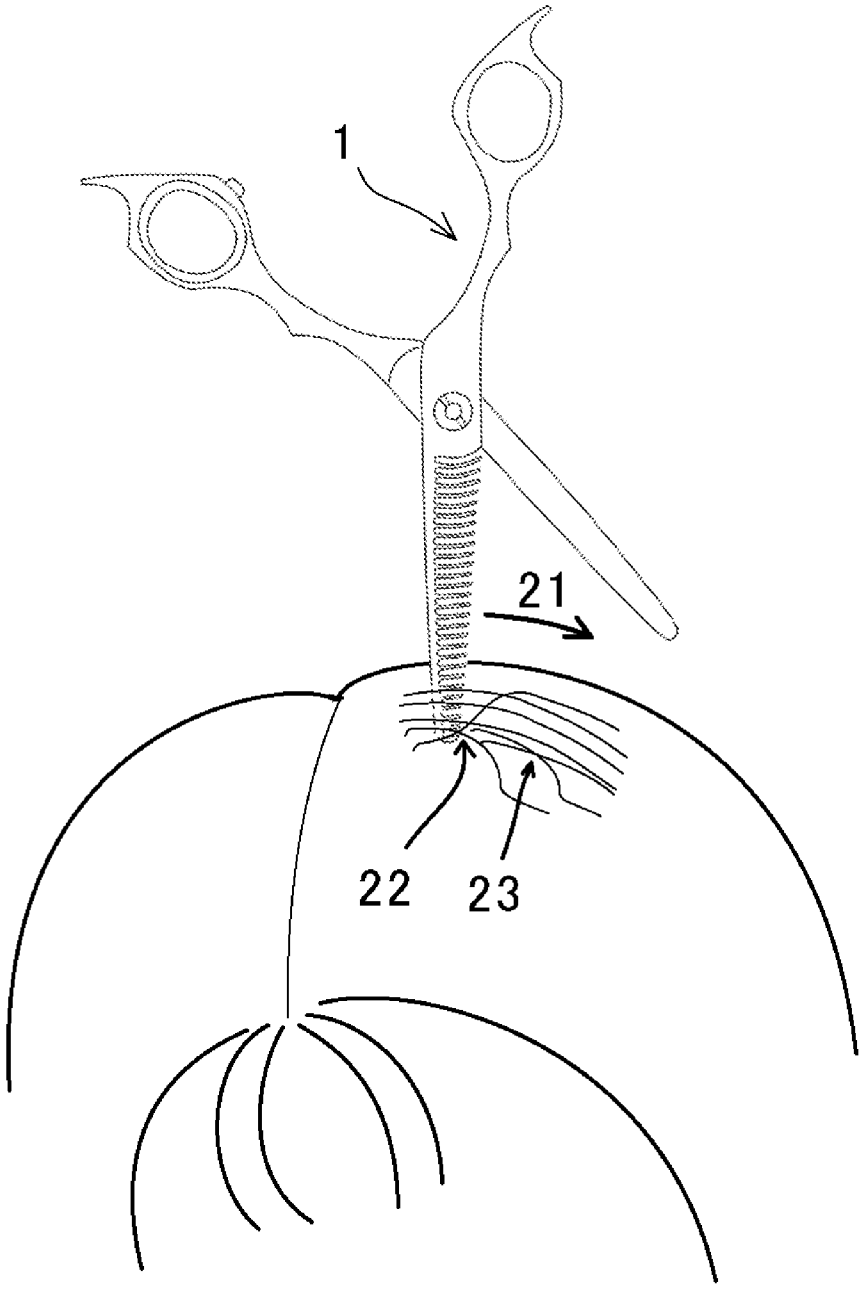
FIG. 5 is a schematic illustration of the hair cutting method as shown in FIG. 4.
Figure 12:
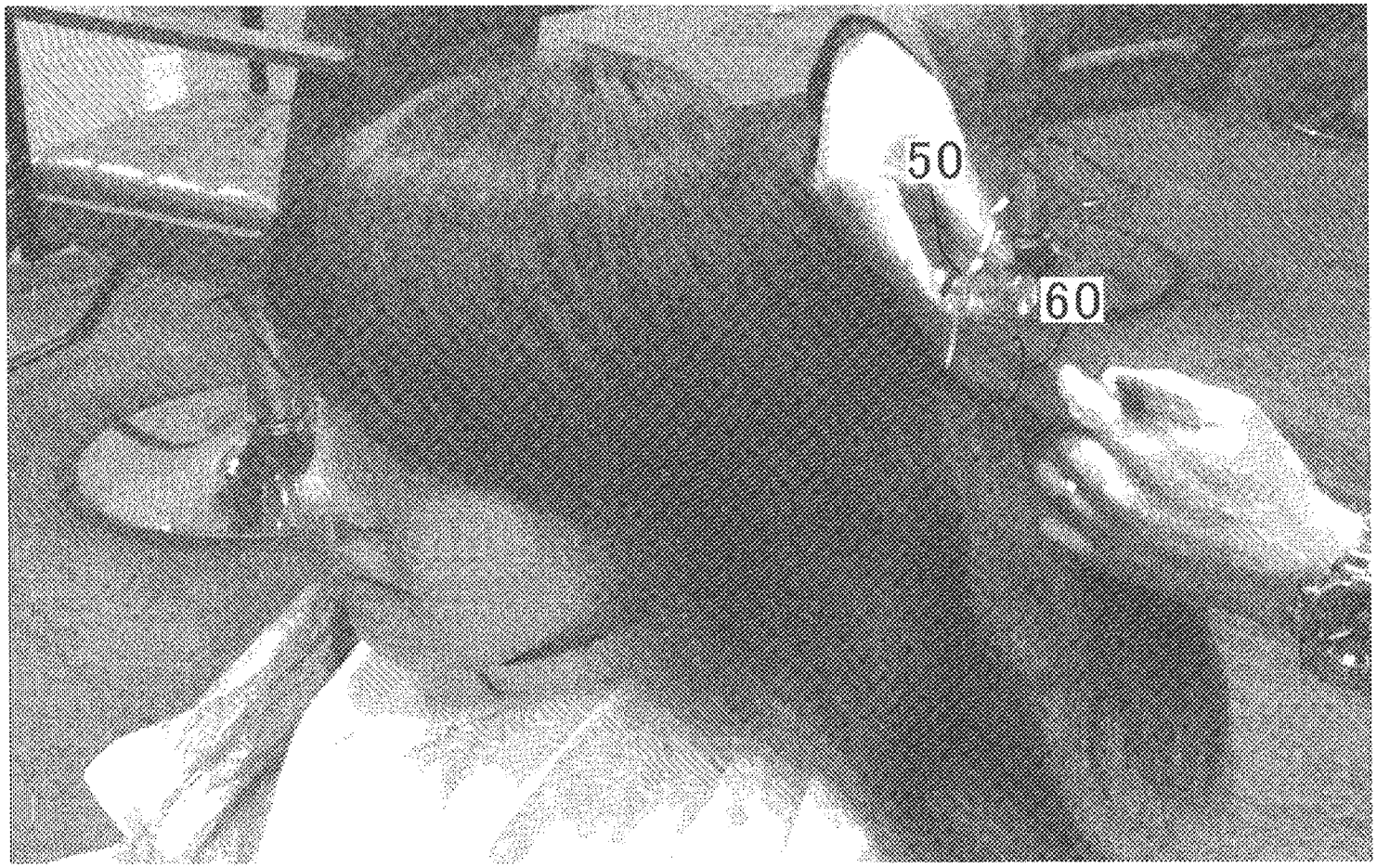
FIG. 12 is a photograph illustrating an example of using conventional shears.

As shown in FIG. 4 and FIG. 5, the shears 1 of the above-described structure are used in a haircutting method comprising moving the comb blade 2 towards the hair growing in the direction that is indicated by arrow 21 in FIG. 5 under the condition that the tip portion of the comb blade 2 is set on the scalp. By performing this haircutting method, the comb blade 2 is used as comb and can shear crosswise hair, indicated by arrows 22 and 23 in FIG. 5, that disturbs combing, by the indentation 6 of the tooth 5 (including the tip tooth 5*a*). Because the teeth 5 are arranged all along the longitudinal portion of the comb blade 2, the shears 1 can be used as thinning shears instead of the conventional thinning shears 50 such as shown in FIG. 12.

Figure 6A:
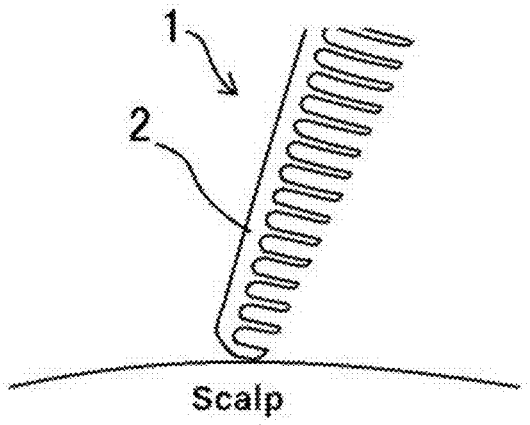
FIG. 6A is an explanatory drawing of the shears of the one embodiment set on the scalp.
Figure 6B:
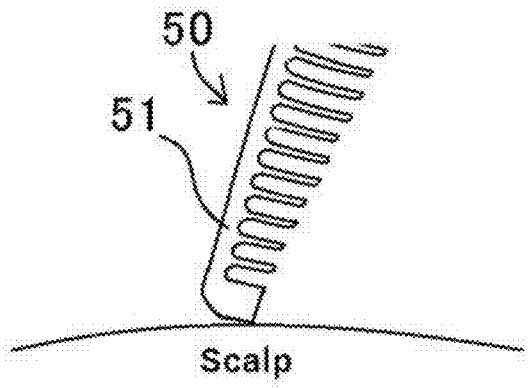
FIG. 6B is an explanatory drawing of conventional shears set on the scalp.

Even if the tip of the comb blade 2 of shears 1 strikes against the scalp, since the corner-rounding processing has been performed on the tip of the comb blade 2 as shown in FIG. 6A, there is little possibility of injuring the scalp. In contrast, if the comb blade 51 of the conventional shears as shown in FIG. 6B is set on the scalp and made to slide, there is a possibility of injuring the scalp. Thus, the shears 1 have a safety structure for setting the comb blade 2 on the scalp and then making it slide.

Figure 7:
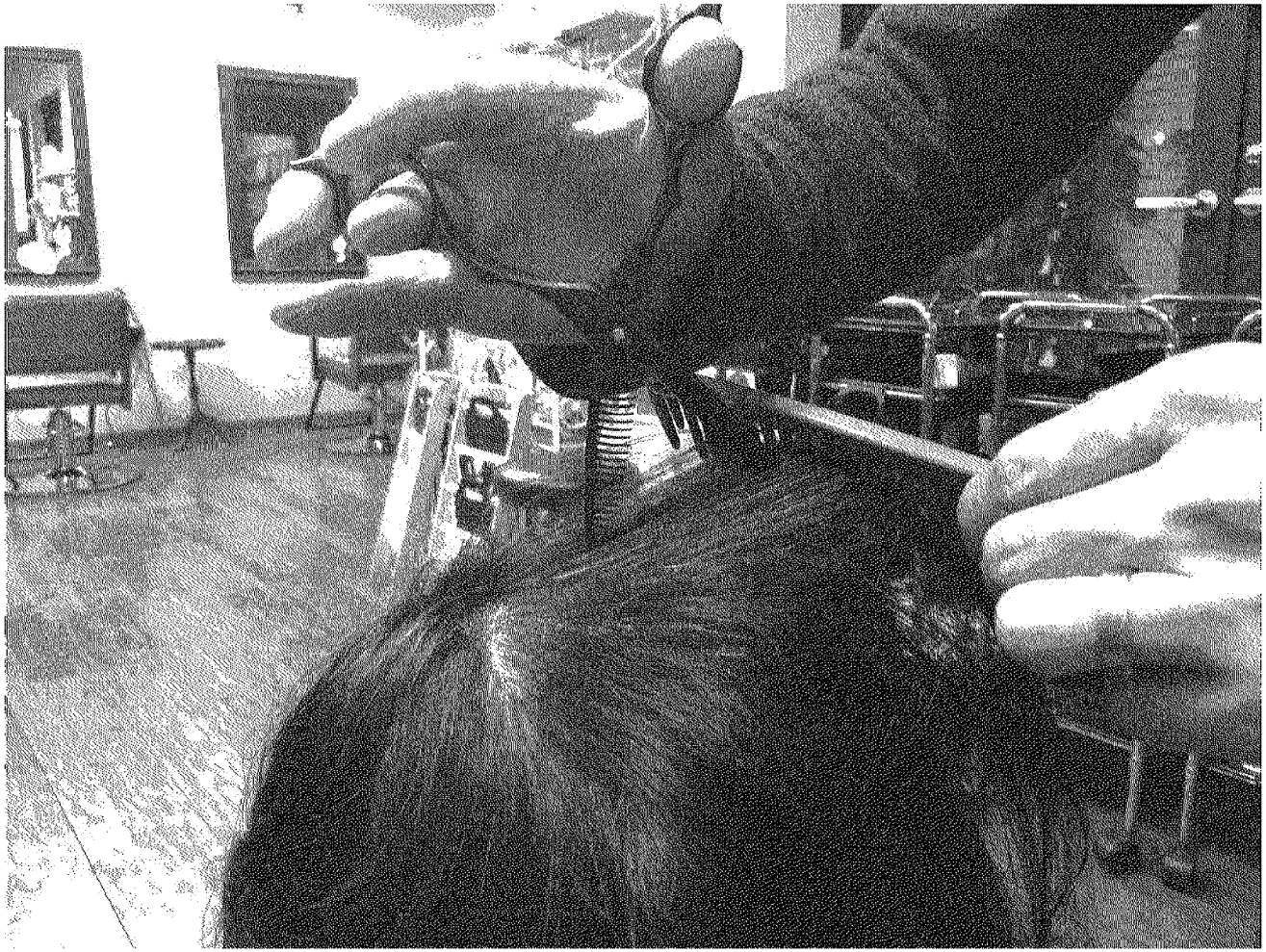
FIG. 7 is a photograph illustrating a hair cutting method comprising picking up a hair bundle, and cutting the hair while the shears are moved along the direction of hair flow.
Figure 8:
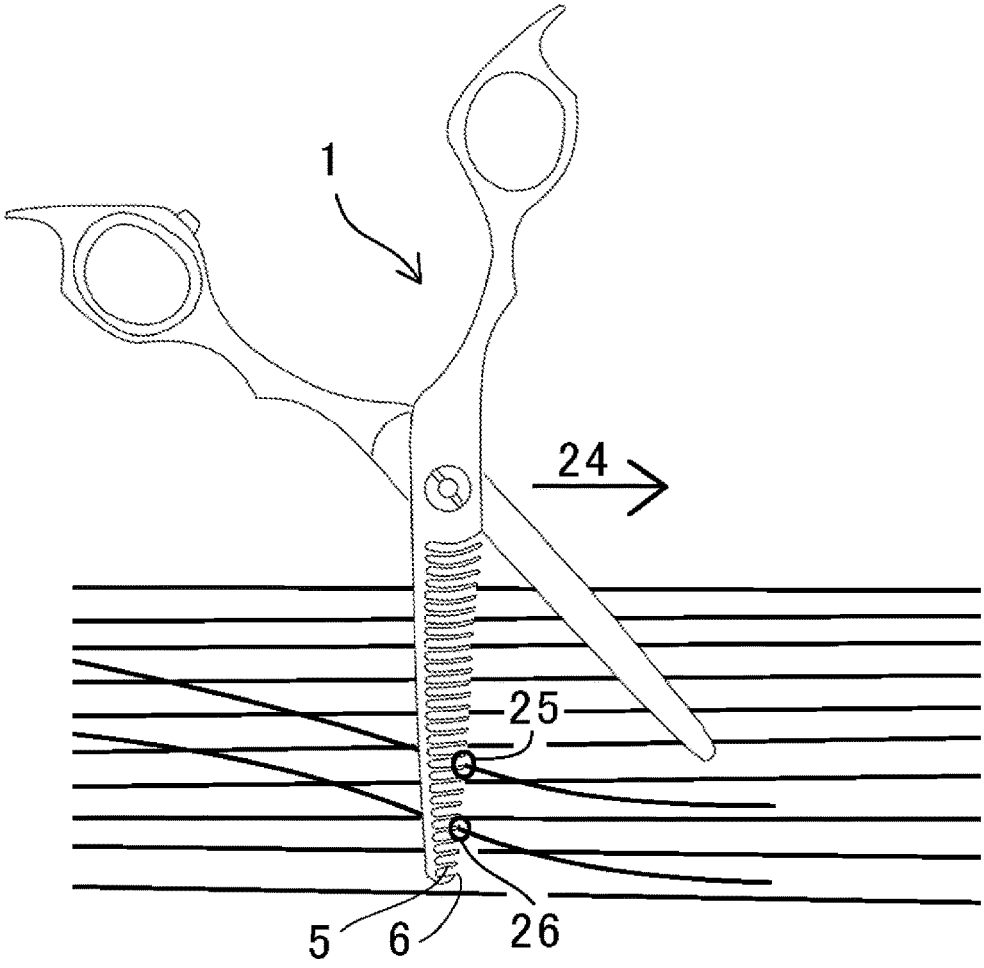
FIG. 8 is an interpretative illustration of the hair cutting being carried out in FIG. 7.

As shown in FIG. 7 and FIG. 8, also a haircutting method comprising holding up a bundle of the hair and making the shears 1 slide along the hair-growth direction (indicated by arrow 24 in FIG. 8) can be performed with the shears 1. In this case, by the indentations 6 of the teeth 5, the shears 1 can effectively cut crosswise hair, indicated by arrows 25 and 26 in FIG. 8, that disturbs combing in a bundle of hair.

Figure 9A:
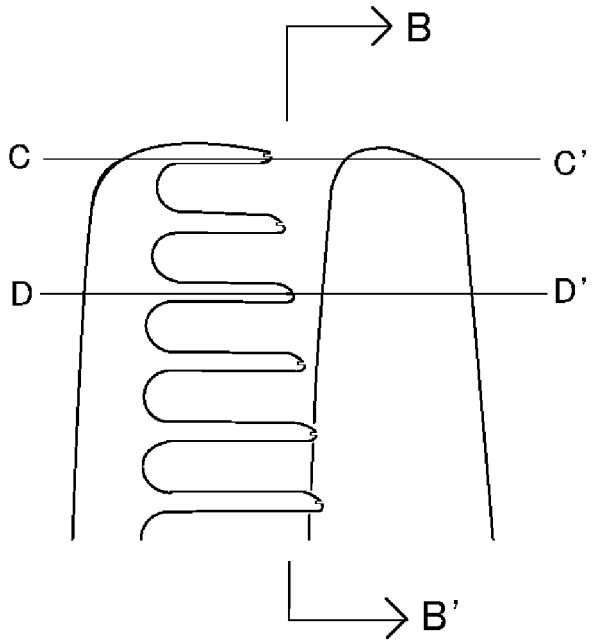
FIG. 9A shows shears just before closing.
Figure 9B:
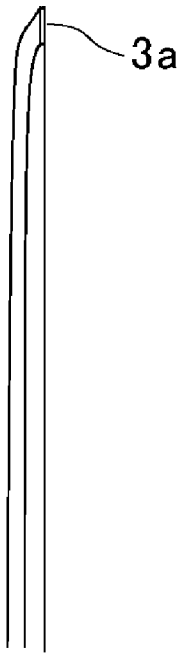
FIG. 9B shows a figure viewed along the direction of the B-B' arrows in FIG. 9A.
Figure 9C:
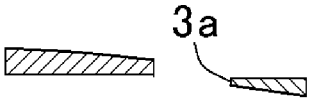
FIG. 9C shows a cross section through the line C-C' in FIG. 9A.
Figure 9D:
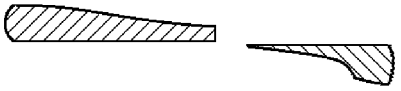
FIG. 9D shows a cross section through the line D-D' in FIG. 9A.

As mentioned above, the corner-rounding processing is performed on the tip portion of the bar blade 3. Also, if attention is given to the principles whereby scissors cut hair by means of shearing force, to the structure of cutting machines (paper cutting machines), and also to the requirement that one to two strands of hair caught in the teeth 5 of the comb blade 2 be cut, then as shown in FIG. 9B and FIG. 9C, the section of the tip portion 3*a* of the bar blade 3 may be rectangular, in the same way as the section of the comb blade 2. By utilizing the above-described structure, risk of injuring the scalp if the scalp is pinched between the bar blade 3 and the teeth 5 of the tip of the comb blade 2 can be significantly reduced. Alternatively, the section from the tip end portion of the bar blade 3, to just before a contact point where the teeth 5 of the tip of comb blade 2 contact the bar blade 3, may be rectangular. In this embodiment, even if the bar blade 3 rubs the scalp directly, the shears can be prevented from injuring the scalp.

Figure 10:
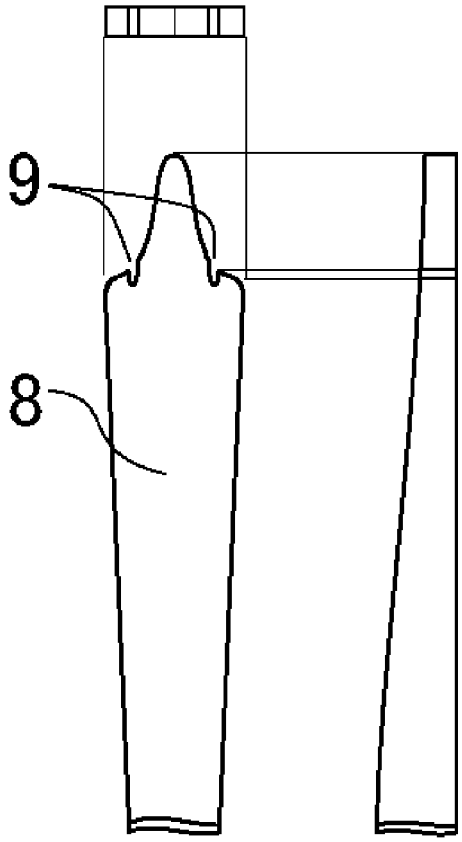
FIG. 10 is three elevation views of a preferable embodiment of the teeth of the comb blade of the shears.

Furthermore, as shown in FIG. 10, teeth 8 can be used as improved teeth instead of the teeth 5 of the comb blade 2. The teeth 8 have a mountain-like form inclining along the tooth-width direction, and preferably have an inclined portion approximating a normal distribution curve as shown, and the inclined portions have two or more indentations 9. On the end portions of the tip of the teeth 8, i.e. the outside portions of the indentations 9 as shown in FIG. 10, the corner-rounding processing has been carried out. Since the teeth 8 of said structure are pointed by comparison with the teeth 5, although not to an extent such that their tip-ends prick the scalp, the ability of the teeth 8 to scoop up crosswise hair is superior, and further, the indentations 9 can efficiently capture the scooped-up crosswise hair.

In addition, various modifications can be done by those skilled in the art, within the scope of the present invention other than the above-described embodiments. For example, although the teeth 5 extend linearly, the teeth 5 can extend arcuately according to the tracks of the motion of the comb blade 2 with the shearing operation as scissors. Thereby, the likelihood of catching crosswise hair in the indentations 6 at the tip of the teeth 5 can be improved.

INDUSTRIAL APPLICABILITY

Although it is assumed that shears of the present invention are used in beauty salons and barber shops, if the essence of invention is taken into consideration, the candidates for use will not be restricted to people. The shears of the present invention can be used as a bladed hand tool for trimming the hair of animals, such as dogs. Therefore, in the present description, although the word "haircut" has been explained giving the example of cutting people's hair, it is to include the meaning of cutting the hair of animals, such as dogs.

DESCRIPTION OF REFERENCE MARKS

1, 50: thinning shears
2, 51: comb blade
3, 52: bar blade
4: slit
5, 5*a*, 8: teeth
6, 9: indentations
7: deepest portion of slit

The invention claimed is:

1. Haircutting thinning shears comprising:

a comb blade and a bar blade, wherein the comb blade is provided with a number of slits spaced apart at intervals, and having teeth between the slits, the slits and the teeth continuing to the comb blade's tip-edge portion such that the tip-edge portion ends in one of the teeth, the comb blade being longer than the bar blade, the comb blade's tip-edge portion being corner-rounding processed to make the tip-edge portion arcuate at its tip and make sharp edges of the arcuate tip rounded, and the tooth in the tip-edge portion having a width not greater than 1 mm; and an indentation being provided in a tip end of each of the teeth; wherein the configuration of the arcuate tip-edge portion and the rounded edges of the comb blade enable the thinning shears to be stood upright on hair on a scalp and the tip-edge portion to be slid along the scalp heading in the direction that the hair grows, to catch in the indentations crosswise hair that grows along the scalp in a direction different from the rest of the hair and cut the crosswise hair with the thinning shears.

2. The thinning shears set forth in claim 1, wherein the comb-blade teeth in their direction orthogonal to the comb blade longitudinally are rectangular in tip-end cross-section; the comb-blade teeth therein shearing hair caught between the comb blade and the bar blade.

3. The thinning shears set forth in claim 1, wherein the bar blade's tip-edge is corner-rounding processed.

4. The thinning shears set forth in claim 3, wherein in cross section the tip-edge portion of the bar blade opposing the teeth in the tip-edge portion of the comb blade is rectangular.

5. The thinning shears set forth in claim 2, wherein the bar blade's tip-edge is corner-rounding processed.

6. The thinning shears set forth in claim 5, wherein in cross section the tip-edge portion of the bar blade opposing the teeth in the tip-edge portion of the comb blade is rectangular.

* * * * *